US008649692B2

(12) United States Patent
Sukesako et al.

(10) Patent No.: US 8,649,692 B2
(45) Date of Patent: Feb. 11, 2014

(54) TONER REPLENISHING DEVICE CAPABLE OF EFFECTIVELY SOFTENING TONER AND IMAGE FORMING APPARATUS WITH TONER REPLENISHING DEVICE

(75) Inventors: Masaki Sukesako, Kanagawa (JP); Tokuya Ohjimi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 171 days.

(21) Appl. No.: 13/251,756

(22) Filed: Oct. 3, 2011

(65) Prior Publication Data

US 2012/0099878 A1 Apr. 26, 2012

(30) Foreign Application Priority Data

Oct. 25, 2010 (JP) ..... 2010-239078

(51) Int. Cl.
*G03G 15/08* (2006.01)

(52) U.S. Cl.
USPC ..... 399/27; 399/29; 399/261

(58) Field of Classification Search
USPC ..... 399/12, 13, 27, 258, 260, 261
See application file for complete search history.

(56) References Cited

U.S. PATENT DOCUMENTS 5,438,393 A * 8/1995 Komatsu et al. ..... 399/59
5,918,094 A * 6/1999 Masuda et al. ..... 399/258
6,337,957 B1 1/2002 Tamaki et al.
6,507,718 B2 1/2003 Ohjimi et al.
6,687,474 B2 2/2004 Yamada et al.
6,856,774 B2 2/2005 Sampe et al.
6,873,814 B2 3/2005 Ohjima et al.
7,333,744 B2 2/2008 Shimojo et al.
7,373,101 B2 5/2008 Hozumi et al.
7,477,856 B2 1/2009 Yoneda et al.
7,539,451 B2 5/2009 Kawasumi et al.
7,672,635 B2 3/2010 Hozumi et al.
8,010,005 B2 8/2011 Sukesako et al.
2005/0232665 A1 10/2005 Toshio et al.
2006/0115286 A1 6/2006 Uchitani et al.
2007/0071502 A1* 3/2007 Shimizu ..... 399/258
2009/0142105 A1* 6/2009 Yanagi ..... 399/265
2010/0040393 A1 2/2010 Kawahara et al.

FOREIGN PATENT DOCUMENTS

JP 10-198147 7/1998
JP 2009-80402 4/2009

* cited by examiner

*Primary Examiner* — Hoan Tran
(74) *Attorney, Agent, or Firm* — Oblon, Spivak, McClelland, Maier & Neustadt, L.L.P

(57) ABSTRACT

A toner replenishing device includes a toner container that stores toner, a toner replenishing device that supplies toner from the toner container to a developing device, and a toner condition detector that detects an aggregated condition of the toner stored in the toner container. A toner softening device is provided to soften toner stored in the toner container. A controller is also provided to drive the toner softening device for a prescribed time period in accordance with a detection result obtained by the toner condition detector.

18 Claims, 8 Drawing Sheets

TONER REPLENISHING DEVICE CAPABLE OF EFFECTIVELY SOFTENING TONER AND IMAGE FORMING APPARATUS WITH TONER REPLENISHING DEVICE

CROSS-REFERENCE TO RELATED APPLICATIONS

This patent application is based on and claims priority pursuant to 35 U.S.C. §119 to Japanese Patent Application No. 2010-239078, filed on Oct. 25, 2010, in the Japan Patent Office, the entire disclosure of which is hereby incorporated herein by reference.

FIELD OF THE INVENTION

The present invention relates to a toner replenishing device capable of effectively softening toner in a toner bottle before replenishing the toner therefrom to a developing device and an image forming apparatus, such as a printer, a facsimile, a copier, etc., including the toner replenishing device.

BACKGROUND OF THE INVENTION

Conventionally, a toner replenishing device that supplies toner from a toner bottle to a developing device is known, for example, as discussed in Japanese Patent Application Laid Open Nos. H10-198147 (JP-H10-198147-A) and 2009-80402 (JP-2009-80402-A). In a two-component developing system that utilizes two-component developer composed of toner and magnetic carrier, a toner density sensor is generally provided to detect density of toner included in the developer stored in the developing device by detecting the magnetic permeability of the developer. Then, replenishment of the toner is controlled based on a detection result to maintain a prescribed density thereof.

However, in an image forming apparatus employing the above-described toner replenishment control, actual toner density is sometimes different from that detected by the toner density sensor depending on dispersion of the toner stored in the toner bottle. In addition, an amount of toner to be supplied from the toner bottle sometimes fluctuates.

More specifically, when a prescribed amount of relatively hard toner (e.g. toner in an advanced state of agglomeration) is supplied to a developing device, a bulk of the developer decreases, and accordingly a bulk density (i.e., a density obtained by dividing a weight of developer in a container by a cubic capacity thereof when the developer as powder is stored in the container) increases more than when a prescribed amount of relatively soft toner (e.g. toner in a well-dispassion state) is supplied thereto. As a result, a distance between carriers in the developer decreases, and a permeability of the developer increases, so that an excessive amount of toner is supplied, that is, more than is ideal, than when relatively soft toner is supplied thereto.

Further, when toner in the toner bottle is relatively hard, and a mohno pump (i.e., a progressive cavity pump) used as a toner supply means is operated for a prescribed time period to supply such toner, a greater amount (i.e., weight) of toner is supplied and image density increases than when the above-described soft toner is supplied. As the image density increases, an excessive amount of toner is consumed and the number of images formed per unit amount of toner (i.e., yield) decreases. Further, various abnormalities, such as scattering of toner, background fogging, etc., occur due to excessive toner density.

To suppress such agglomeration of the toner, the toner replenishing device employed in each of JP-H10-198147-A and JP-2009-80402-A includes multiple toner bottles, and rotates one of them while replenishing the toner from another one of them.

However, in such a conventional toner replenishing device, although the toner in the toner bottle other than that replenishing the toner is soft (i.e., dispersed) due to the rotation of the toner bottle, the toner replenishing bottle immediately starts replenishing the toner without any preparatory rotation. Consequently, when toner is supplied after an extended period of inactivity, toner aggregates and is possibly supplied as is from the toner bottle to the developing device. In such a situation, it is possible to replenish the toner from the toner bottle to the developing device after rotating the toner bottle a prescribed times to soften the toner beforehand. However, when a toner bottle is always rotated by a prescribed number of times to soften the toner therein regardless of its aggregated condition, completion of toner replenishment to a developing device is delayed, and accordingly an apparatus downtime increases.

BRIEF SUMMARY OF THE INVENTION

Accordingly, the present invention provides a novel toner replenishing device that comprises a toner container that stores toner, a toner replenishing device that supplies toner from the toner container to a developing device, and a toner condition detector that detects an aggregated condition of the toner stored in the toner container. A toner softening device is provided to soften toner stored in the toner container. A controller is also provided to drive the toner softening device for a prescribed time period in accordance with a detection result of the toner condition detector.

In another aspect, the toner condition detector detects the toner agglomeration condition based on a toner replenishment coefficient, which is determined by the controller based on a maximum toner storage capacity of the toner container, an amount of toner currently stored in the toner container (before replenishment thereof), and an apparent density of soft toner stored in the toner container. The apparent density of soft toner is obtained by dividing the total weight of the soft toner filling a bottle by a cubic value of the bottle.

In yet another aspect, the toner replenishment coefficient W is calculated by the following formula;

$$W=X[g]\div Y[g/cm^3]\div Z[cm^3],$$

wherein X represents an amount of toner currently stored in a bottle, Y represents an apparent density of soft toner, and Z represents a capacity of the bottle.

In yet another aspect, the toner softening device rotates the toner container.

In yet another aspect, the controller shortens the prescribed time period for driving the toner softening device when the toner replenishment coefficient is equal to or less than a prescribed threshold than when the toner replenishment coefficient is more than the prescribed threshold.

In yet another aspect, the toner container is detachably attached to the image forming apparatus, and includes a non-volatile memory to store the toner replenishment coefficient. The toner condition detector calculates and updates the toner replenishment coefficient in the non-volatile memory after every toner replenishment operation.

In yet another aspect, the toner condition detector corrects the toner replenishment coefficient in accordance with a time period elapsed after the last toner replenishment operation, and detects the toner agglomeration condition based on the corrected toner replenishment coefficient.

In yet another aspect, the aggregated condition detector corrects the toner replenishment coefficient in accordance with temperature in the image forming apparatus, and detects the toner agglomeration condition based on the corrected toner replenishment coefficient.

BRIEF DESCRIPTION OF THE SEVERAL VIEWS OF THE DRAWINGS

A complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
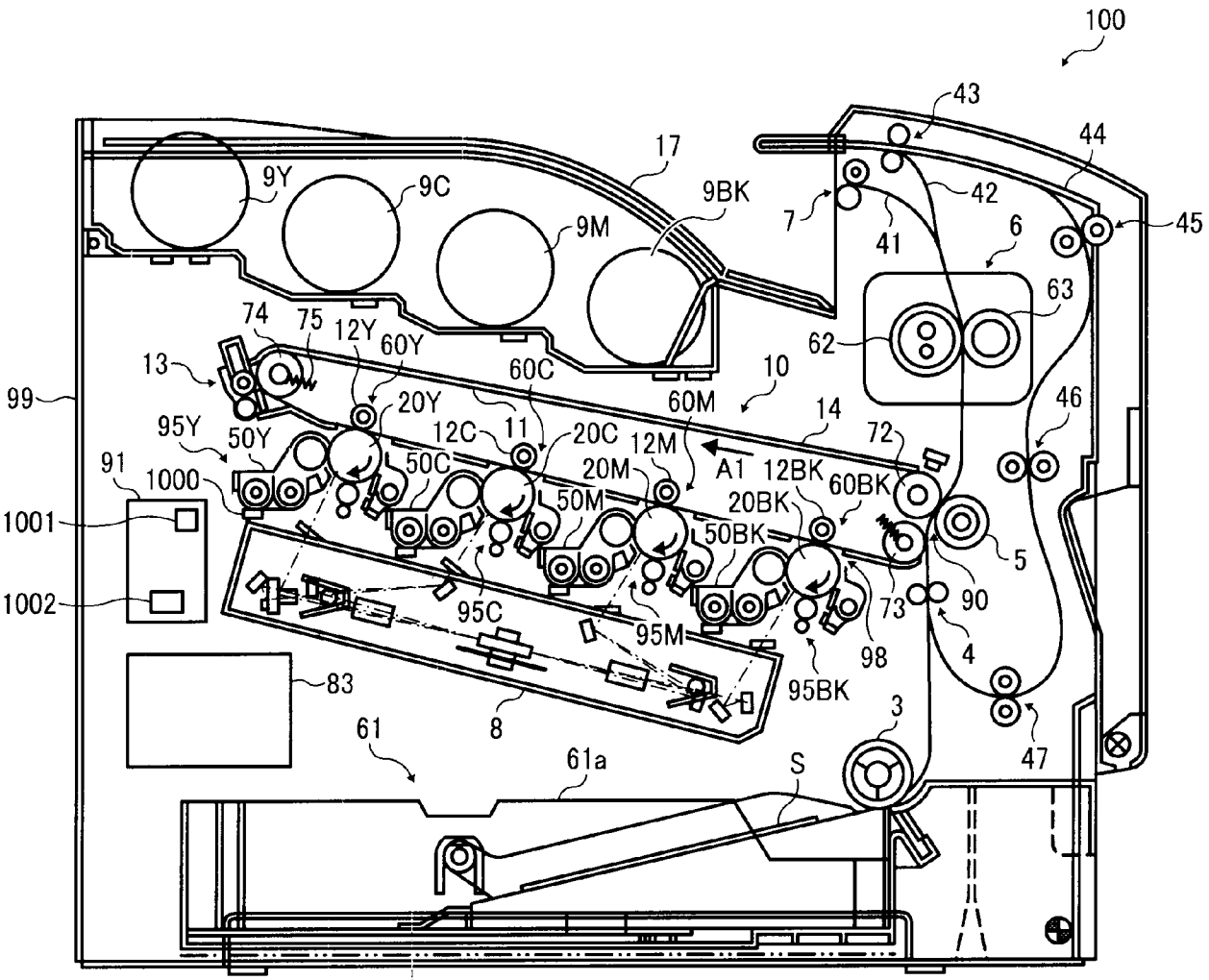
FIG. 1 schematically illustrates a configuration of an image forming apparatus to which one embodiment of the present invention is applied.

Referring now to the drawings, wherein like reference numerals designate identical or corresponding parts throughout several views, in particular in FIG. 1, an exemplary image forming apparatus to which one embodiment of the present invention is applied is illustrated. Although an image forming apparatus 100 shown in FIG. 1 is a color laser printer capable of forming a color image, the present invention can be applied to the other type of an image forming apparatus, such as a printer, a facsimile, a copier, a multifunctional machine combining the copier with the printer or the like, etc.

The image forming apparatus 100 forms an image on a sheet like recording medium, such as an OHP (Over Head Projector) sheet, a card, a postcard, etc., other than a plain paper generally used in copying or similar devices in accordance with an image signal of image information externally inputted thereto.

The image forming apparatus 100 employs a tandem type photoconductive drums 20Y, 20M, 20C, and 20BK as image bearers capable of forming images of yellow, magenta, cyan, and black component colors, respectively. Suffixes Y, M, C, and BK represent yellow, magenta, cyan, and black color use members, respectively. These photoconductive drums 20Y, 20M, 20C, and 20BK are disposed on an image formation side (i.e., an outer circumference side) of an intermediate transfer belt 11 substantially disposed at a center of a body 99 of the image forming apparatus 100.

The intermediate transfer belt 11 is movable in a direction as shown by an arrow A1 and is opposed to the respective photoconductive drums 20Y, 20M, 20C, and 20BK, arranged in this order in the direction. The respectively visualized toner images on the photoconductive drums 20Y, 20M, 20C, and 20BK are transferred and superimposed on the intermediate transfer belt 11 moving in the direction, and are transferred at once onto a transfer sheet A. Accordingly, the image forming apparatus 100 employs an intermediate transfer type system.

Specifically, a lower side of the intermediate transfer belt 11 is opposed to the respective photoconductive drums 20Y, 20M, 20C, and 20BK and provides primary transfer sections 98 in which the toner images are transferred from the respective photoconductive drums 20Y, 20M, 20C, and 20BK onto the intermediate transfer belt 11. The above-described superimposing transfer process is executed on the intermediate transfer belt 11 during movement thereof in the direction A1 while applying prescribed voltages from primary transfer rollers 12Y, 12M, 12C, and 12BK so that the toner images formed on the respective photoconductive drums 20Y are transferred and superimposed at the same position thereof at different times, respectively, from upstream to downstream in the direction A1.

The intermediate transfer belt 11 includes a base layer made of material creating a small strain. The base layer is covered with a coat layer made of fine smoothing performance, thereby forming multiple layers. As material of the base layer, fluorine resin, a PVD sheet, or polyimide resin and the like is exemplified. As material of the coat layer, fluorine resin or the like is exemplified.

Further, the intermediate transfer belt 11 is provided with a skew prevention guide, not shown, at it one edge to prevent deviation thereof in one of directions perpendicular to a plane of FIG. 1 during the movement in the direction A1. The skew prevention guide may be made of urethane rubber, silicon rubber, or various other rubbers.

These photoconductive drums 20Y, 20M, 20C, and 20BK are included in image formation units 60Y, 60M, 60C, and 60BK as toner image formation devices, respectively.

An exemplary configuration of the image formation units 60Y having the photoconductive drum 20Y is described herein below as a typical example among the other image formation units 60M, 60C, and 60BK. The image formation unit 60Y includes a primary transfer roller 12Y, a cleaner, a charge device, and a developing device 50Y around the photoconductive drum 20Y in a clockwise rotational direction in this order.

The charge device includes a charge roller that engages the photoconductive drum 20Y and is thereby driven and rotated. The charge device also includes a cleaning roller that engages the charge roller and is thereby driven and rotated. A voltage applicator, not shown, is connected to the charge roller to apply a bias composed of a direct current superimposed by an AC current component. The voltage applicator, removes charge remaining on the photoconductive drum 20Y at a charge region opposed to the photoconductive drum 20Y, and at the same time applies charge having a prescribed polarity thereto. The cleaning roller cleans the charge roller by its rotation when driven by the charge roller. Although a contact roller charge system is employed in this embodiment, an adjacent roller or a corotron (electrostatic charger using a corona discharge) system can be employed alternatively.

The developing device 50Y includes a developing roller opposed to in the vicinity of the photoconductive drum 20Y, and visualizes a latent image as a yellow toner image on the surface thereof by electrostatically moving yellow toner thereto in a developing region provided between the developing roller and the photoconductive drum 20Y.

A primary transfer bias power source, not shown, applies a prescribed voltage suitable for a primary transfer process to the primary transfer roller 12Y under control of a controller 91.

The cleaner includes a cleaning housing having an opening at a section opposed to the photoconductive drum 20Y, a cleaning brush that cleans the photoconductive drum 20Y by contacting and scraping unfavorable substance, such as residual toner, carrier, paper dust, etc., remaining thereon, and a cleaning blade that cleans the photoconductive drum 20Y by contacting and scraping the unfavorable substance remaining thereon at downstream of the cleaning brush in a rotational direction of the photoconductive drum 20Y. The cleaner further includes an ejection screw or similar devices freely rotatably supported by the cleaning housing and conveys used toner or the like removed by the cleaning bush and blade as described above to a used toner tank as a part of a used toner conveyance path.

The image formation unit 60Y including the photoconductive drum 12Y, the cleaner, the charger, and the developing device 50Y collectively constitute a process cartridge 95Y as a process unit excluding the primary transfer roller 12Y. The process cartridge 95Y is detachably attached to a body of the image forming apparatus 100 from a front side of a plane of the drawing of FIG. 1.

Further, the photoconductive drum 20Y is independently-detachably attached to a body of the image forming apparatus 100 from a front side of the plane of the drawing of FIG. 1. The developing device 50Y is also independentlydetachably attached to a body of the image forming apparatus 100 from a front side of the plane of the drawing of FIG. 1 to replace developer or the like. The process cartridge 95Y is also detachably attached to a body of the image forming apparatus 100 from a front side of the plane of the drawing of FIG. 1. The process cartridge 95Y is separately detached from the photoconductive drum 20Y and the developing device 50Y remaining in the image forming apparatus 100.

A transfer belt unit 10 including an intermediate transfer belt 11 is provided above to the photoconductive drums 20Y, 20M, 20C, and 20BK with it being opposed thereto. The transfer belt unit 10 further includes a driving roller 72, a transfer inlet roller 73, and a cleaner opposed roller 74 collectively winding the intermediate transfer belt 11 thereabout. Further included in the transfer belt unit 10 is a bias spring 75 that increases tension of the intermediate transfer belt 11 by applying a bias to the cleaner opposed roller. The transfer belt unit 10 is freely detachably attached to the body 99 holding the image formation unit 60Y constituted by the primary transfer roller 12Y, the driving roller 72, the transfer inlet roller 73, the cleaner opposed roller 74, and the spring 75 on an intermediate transfer belt housing 14. Further, a belt cleaner 13 is opposed to the intermediate transfer belt 11 and is held on the intermediate transfer belt housing 14 to clean the surface of the intermediate transfer belt 11. The transfer belt unit 10 further includes a driving system, not shown, that drives and rotates the driving roller 72, a primary bias power source, not shown, that applies a primary transfer bias to each of the primary transfer rollers 12Y, 12M, 12C, and 12BK, and a secondary bias power source, not shown, that applies a secondary transfer bias to the opposed roller (i.e., the driving roller) 72.

The transfer inlet roller 73 and the cleaner opposed roller 74 are driven by the intermediate transfer belt 11 driven by the driving roller 72. The primary transfer rollers 12Y, 12M, 12C, and 12BK press the intermediate transfer belt 11 from its backside toward the photoconductive drums 20Y, 20M, 20C, and 20BK thereby forming the primary transfer nips, respectively. The primary transfer nips are formed on a stretching section on the intermediate transfer belt 11 between the transfer inlet roller 73 and the cleaner opposed roller 74. These transfer inlet roller 73 and the cleaner opposed roller 74 collectively stabilize the primary transfer nips.

The primary transfer biases create primary transfer electric fields between the photoconductive drums 20Y, 20M, 20C, and 20BK and the primary transfer rollers 12Y, 12M, 12C, and 12BK in the respective primary transfer nips. The toner images of respective component colors formed on the photoconductive drums 20Y, 20M, 20C, and 20BK are primarily transferred onto the intermediate transfer belt 11 under influence of the primary transfer electric fields and nip pressures. The driving roller 72 is pressed against the second transfer roller 5 via the intermediate transfer belt 11, thereby forming the second transfer nip 90. The cleaner opposed roller 74 serves as a tension roller to apply a prescribed tension suitable for respective transfer processes to the intermediate transfer belt 11 based on a function of the spring 75.

The belt cleaner 13 is opposed to the intermediate transfer belt 11 on the left side of the cleaner opposed roller 74 in the drawing. Although it is not shown, the belt cleaner 13 includes a cleaning brush and a cleaning blade contacting and collectively cleaning the intermediate transfer belt 11 by scraping and removing alien substance, such as residual toner, etc., remaining thereon. Such unfavorable alien substance produced by the cleaning process is collected into a used toner tank 83 via a used toner path, not shown.

The belt cleaner 13 and the cleaner opposed roller 74 move upwardly together with the primary transfer rollers 12Y, 12M, and 12C to separate the intermediate transfer belt 11 from the photoconductive drums 20Y, 20M, and 20C.

There is provided am optical scanner 8 as a writing unit below the image formation units 60Y, 60M, 60C, and 60BK. The optical scanner 8 emits an optically modulated laser light onto the respective photoconductive drums 20Y already charged by the charge rollers between the charge and developing regions and decreases voltages on the surface thereof, so that differences in voltage are generated and latent images are accordingly formed thereon.

There is provided a sheet feeder 61 below the optical scanner 8. The sheet feeder 61 includes a sheet feeding cassette 61*a* that accommodates a bundle of multiple transfer sheets S, and a sheet feeding roller 3 that contacts an upper surface of the transfer sheet S. Thus, when the sheet feeding roller 3 is driven and rotated counter clockwise, the topmost transfer sheet S is fed toward a pair of registration rollers 4. An outer diameter of each of the pair of registration rollers is precisely processed to match a sheet feeding speed with a movement speed of the intermediate transfer belt 11, i.e., an image formation speed. A tolerance of such an outer diameter is equal to or less than 0.03 mm.

The secondary transfer roller 5 is opposed to the driving roller 72 via the of the intermediate transfer belt 11, and is driven and rotated by the intermediate transfer belt 11. The secondary transfer roller 5 includes a core metal and a sponge layer overlying the core metal. A secondary transfer bias is applied to a secondary transfer nip 90 formed between the driving roller 72, the intermediate transfer belt 11, and the secondary transfer roller 5, thereby creating a secondary transfer electric field therein. A toner image on the intermediate transfer belt 11 is secondarily transferred onto the transfer sheet S by influence of the secondary transfer electric field and the nip pressure. Specifically, the driving roller 72 serves as an opposed roller. The secondary transfer bias applied to the driving roller 72 using a repelling force bias system in this embodiment. However, an attraction force bias system can be employed alternatively. Further, a secondary transfer bias power source, not shown, applies a prescribed appropriate voltage suitable for the secondary transfer process under control of the controller 91. Specifically, the controller 91 and the secondary transfer bias power source collectively constitute a bias applicator.

On the downstream side in the sheet conveyance direction of the secondary transfer nip 90, a fixing device 6 of a roller type is provided to fix the toner image onto the transfer sheet S. The fixing device 6 includes a fixing roller 62 including a heat source and a pressing roller 63 pressing against the fixing roller 62. By conveying the transfer sheet S with the toner image through a fixing section in which the fixing roller 62 presses against the pressing roller, the toner image is fixed onto the surface of the transfer sheet S due to heat and pressure thereof.

Multiple toner bottles 99Y, 9M, 9C, and 9BK are freely detachably attached to the image forming apparatus 100 above the transfer belt unit 10 while storing toner particles of yellow, magenta, cyan, and black colors as toner replenishing members, respectively. Plural toner supplying mechanisms, not shown, are provided each to replenish a prescribed amount of toner of a component color to corresponding on of developing devices 50Y, 50M, 50C, and 50BK provided in the image formation units 60Y, 60M, 60C, and 60BK respectively. The toner bottles 9Y, 9M, 9C, and 9BK are consumable items and are detached from the body 99 to be replaced with new bottles, respectively.

Further, the image forming apparatus 100 includes an control panel, not shown, for inputting various conditions of image formation and a controller 91 having a CPU (Central Control Unit), not shown, that generally controls the image forming apparatus 100, and a memory or the like. Various information pieces inputted through the control panel are recognized by the controller 91. The control panel includes a display as an outputting device controlled by the controller 91 to display prescribed information. The controller 91 controls an operation of the primary transfer bias power source to apply a primary transfer bias to the primary transfer roller. The controller 91 further controls an operation of the secondary transfer bias power source to apply a secondary transfer bias to the secondary transfer roller 72. Specifically, the controller 91 and the secondary transfer bias power source collectively constitute the secondary transfer bias applicator.

When a signal instructing color image formation is inputted to the image forming apparatus 100, the driving roller 72, the transfer belt 11, the transfer inlet roller 73, and the cleaner opposed roller 74 are driven. At the same time, the photoconductive drums 20Y, 20M, 20C, and 20BK are also driven and rotated. Then, the surface of the photoconductive drum 20Y is uniformly charged by the charge roller as it rotates, and is subjected to exposure scanning of the laser light emitted from the optical writer 8, thereby forming a latent image thereon. The latent image is subsequently developed to be a yellow toner image by the developing device 50Y, and is primarily transferred by the primary transfer roller 12Y onto the transfer belt 11 moving in a direction of A1. The cleaner removes unfavorable substance including toner remaining on the surface of the photoconductive drum 20Y after the primary transfer process. The surface of the photoconductive drum 20Y is subsequently subjected to the next charge removing and applying processes.

In the rest of the photoconductive drums 20C to 20BK, toner images of respective colors are similarly formed thereon, and are transferred on to the same position of the intermediate transfer belt 11 moving in the direction A1 by the primary transfer rollers 12C to 12BK. The thus superimposed toner images on the intermediate transfer belt 11 are moved to the secondary transfer section 90 opposed to the secondary transfer roller 5, and are secondarily transferred onto the transfer sheet S.

The transfer sheet S is launched by the sheet feeding roller 3 from the sheet feeder 61, and is further conveyed by the pair of registration rollers 4 in response to a detection signal generated by a sensor to synchronize with a leading end of the toner image on the intermediate transfer belt 11 at a section opposed to the secondary transfer roller 5 between the transfer belt 11 and the second transfer roller 5. When the transfer sheet S receives and bears toner images of all of component colors, it enters the fixing device 6, so that these toner images are fixed by heat and pressure during passage of the fixing section between the fixing roller 62 and the pressing roller 63. Consequently, a synthesized color image is fixed onto the transfer sheet S. The transfer sheet S with the thus fixed color image is subsequently stacked on a sheet ejection tray 17 provided on the body 99 via a sheet ejection roller 7. At the same time, the transfer belt 11 having completed the secondary transfer process is cleaned by the cleaning brush and blade provided in the cleaner 13 to prepare for the next processes of the charge and development.

In such an image formation process, since the toner particles of respective colors of yellow, magenta, cyan, and black are consumed in the developing devices 50Y, 50M, 50C, and 50BK, the below described respective toner replenishing devices supply a prescribed amount of toner particles of a corresponding color from the toner bottles 9Y, 9M, 9C, and 9BK to the developing devices 50Y, 50M, 50C, and 50BK upon consumption.

Figure 2:
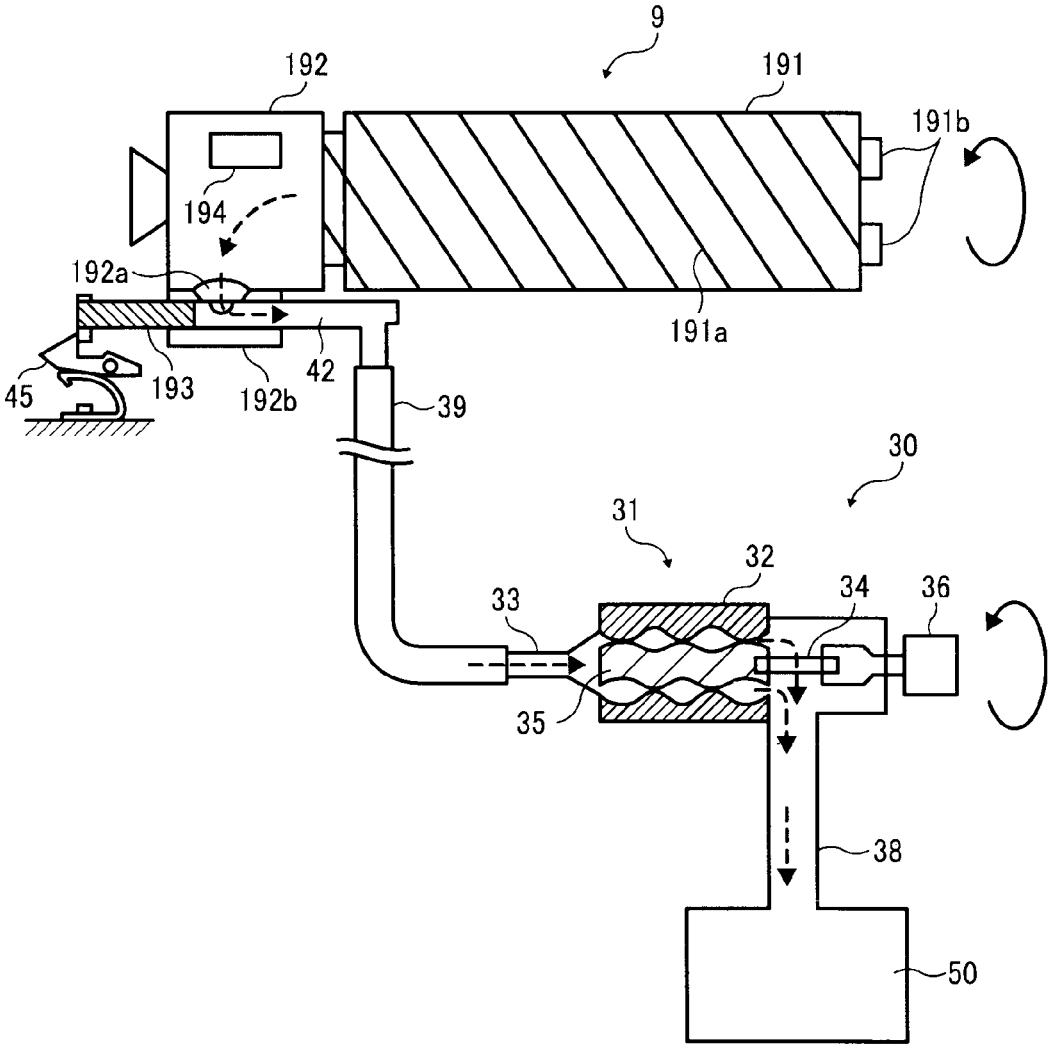
FIG. 2 is an enlarged view illustrating a toner replenishing device provided in the image forming apparatus of FIG. 1.

Now, an exemplary toner replenishing device as a feature of one embodiment of the present invention is described with reference to FIG. 2 and the like. First, toner replenishing devices for yellow, magenta, cyan, and black colors have substantially the same configurations to each other except for a color of toner used in an image formation process in this embodiment. As shown in FIG. 2, an exemplary toner replenishing device 30 includes a toner bottle 9. The toner bottle 9 includes a bottle section 191 and a cap 192 that engages a head of the bottle section 191 and rotatably holds the bottle section. When the toner bottle 9 is attached to the body 99, a nozzle 42 is inserted into an opening 192*b* formed on the cap 192 in response thereto. At that time, an opening plug 193 serving as an opening and closing member provided in the toner bottle 9 opens a toner ejection outlet (i.e., a powder ejection outlet) with its being sandwiched by the nozzle 42 and a pick 45. Hence, a toner receiving inlet (i.e., a powder ejection inlet) formed on the nozzle 42 is communicated with the toner ejection outlet 192*a*, so that toner stored in the bottle section 191 of the toner bottle 9 is conveyed into the nozzle 42 via the toner ejection outlet 192*a*.

Further, the other end of the nozzle 42 is connected to one end of a tube 39 serving as a toner replenishment path. The tube 39 is made of flexible material having an excellent toner resistant performance, and the other end of the tube is connected to a screw pump 31 (e.g. a suction pump) as the toner supplier of the toner replenishing device 30. Such flexible material of the tube 39 may be rubber, such as polyurethane, nytril, EPDM, silicon, etc., and resin, such as polyethylene, nylon, etc. With such a tube 39, a freedom of layout of the toner replenishment path increases, thereby downsizing the image forming apparatus 100.

The screw pump 31 is a suction and single axis eccentric type, which includes a rotor 35, a stator 32, and a suction opening 33. Also included in the screw pump 31 are a universal joint 34 and a motor or the like. The rotor 35, the stator 32, and the universal joint 34 or the like are housed in a casing, not shown. The stator 32 is an elastic female screw made of rubber or the like having spiral grooves of double pitches thereon. The rotor 35 is a rigid mail screw made of metal or the like having a spiral shape thereon to freely rotatably fit into the stator 32. One end of the rotor 35 is connected to a motor 36 via the universal joint 34.

The screw pump 31 creates a suction force at the suction opening 33 as the motor 36 drives and rotates the rotor 35 in the stator 32 in a prescribed direction. Specifically, air is evacuated from the tube 39, thereby generating a negative pressure therein. Hence, the toner in the toner bottle 9 is sucked together with the air toward the suction opening 33 via the tube 39. The toner sucked and moved to the suction opening 33 is launched into a gap between the stator and the rotor 35, and is further conveyed toward the other end thereof as the rotor rotates. The toner is subsequently replenished in the developing device 50 via the toner conveyance pipe 38. In such a system, a hopper can be provided to temporarily store the toner to be replenished to the developing device 50 between the screw pump 31 and the developing device 50.

The bottle section 191 of the toner bottle 9 is formed substantially in a hollow cylindrical shape including a spiral protrusion on an inner circumferential surface thereof. Specifically, a spiral groove is formed when viewed from an outer circumferential surface side. Accordingly, when a toner container driver, not shown, provided in the body 99 drives and rotates the bottle section 191 in a direction as shown in the drawing, the spiral protrusion 191*a* conveys the toner from the bottle section 191 toward a space within the cap 192.

Figure 3:
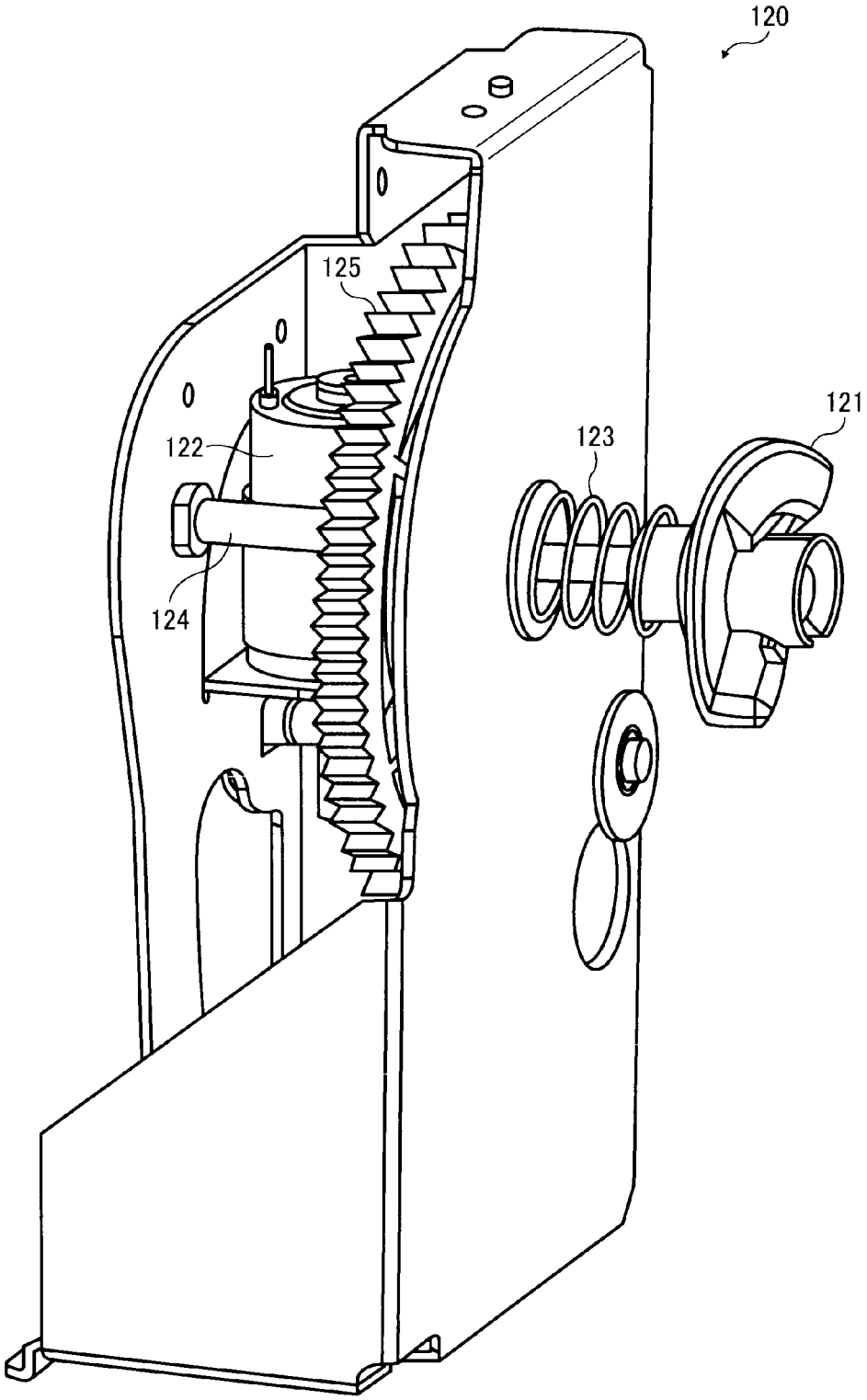
FIG. 3 is a perspective view illustrating a driving unit for driving a toner bottle provided in a printer according to one embodiment of the present invention.

Now, an exemplary toner bottle driving unit 120 serving as a toner softening device is described with reference to FIG. 3. The toner bottle driving unit 120 includes a drive coupling 121, a driving motor 122, and a spring 123. A shaft 124 or the like is also included in the toner bottle driving unit 120. The drive coupling 121 engages a driving force input section 191*b* formed on a bottom of the bottle section 191 (see FIG. 2). The driving coupling 121 is linked with the driving motor 122 via the shaft 124 and a gear 125 provided on the shaft 124, so that a driving force of the driving motor 122 is transmitted to the driving coupling 121 via the shaft 124 and the gear 125. The driving force is further transmitted to the bottle section 191 via the driving force input section 191*b* of the toner bottle 9, which is engaged with the driving coup 121, thereby rotating the bottle section 191. With such rotation, the toner in the toner bottle 9 is softened and is launched out toward the space in the cap 192 by the spiral protrusion 191*a*.

Two component developer having toner and carrier is stored in the developing device 50. The developing device 50 includes a toner density sensor 1000 to detect magnetic permeability of the developer. A result of detection of the magnetic permeability of the developer is transmitted as a voltage signal to the controller 91. In other words, since the magnetic permeability correlates with toner density of developer, the toner density sensor 1000 outputs a voltage in accordance with the toner density. The above-described controller 91 includes a RAM (Random Access Memory) storing data of a target value Vtref of a voltage to be outputted from the toner density sensor 1000. The controller 91 calculates a difference ΔT between an output voltage Vt outputted from the toner density sensor 1000 and the target value Vtref (i.e., Vref−Vt), and recognizes that the toner density is sufficiently high and does not replenish toner when the difference ΔT is positive (+). By contrast, when the difference ΔT is negative (−), the controller 91 controls the screw pump 31 to operate fore a prescribed time period in accordance with an absolute value of the difference ΔT. Hence, an appropriate amount of toner is added to the developer that decreases density of the toner as development proceeds in the developing device 50.

However, even though the toner is supplied in the above-described manner, actual toner density is sometimes different from a density that is detected by the toner density sensor 1000 depending on an agglomeration condition of the toner in the toner bottle 9. In addition, an amount of the toner to be supplied fluctuates depending thereon.

As a result, toner density cannot sometimes be maintained at a prescribed level.

Figure 4:
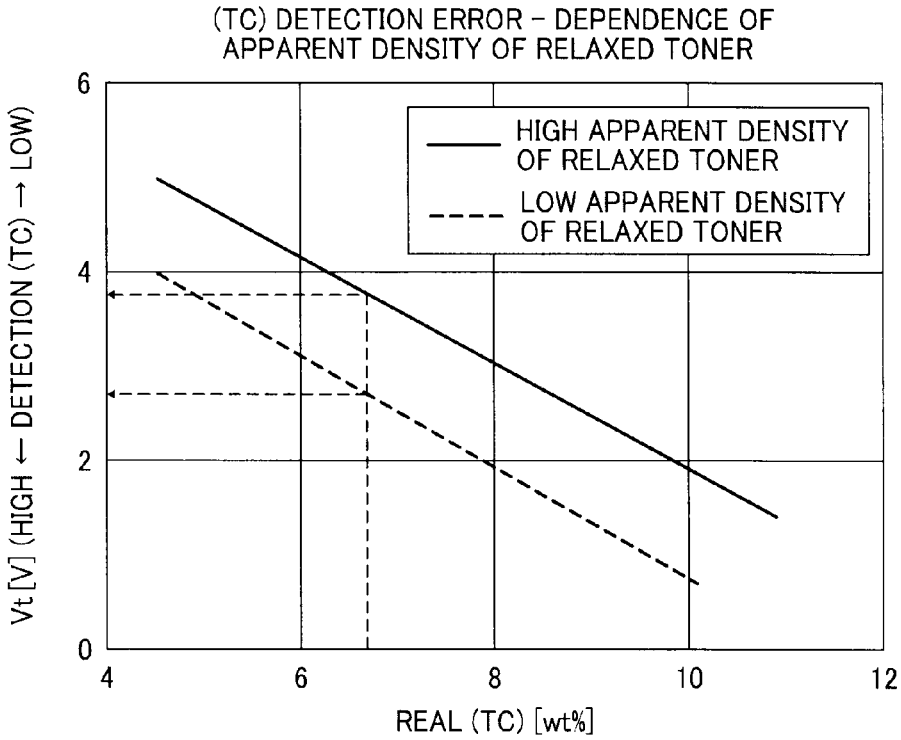
FIG. 4 illustrates an output error of a toner density sensor generated when toner aggregates in a toner bottle.

Then, the applicant has experimented in the density as described below. Initially, two samples of two-component developer particles having the same density are prepared. Subsequently, an apparent soft density of toner particles included in one of the two samples is increased by applying a prescribed pressure thereon, while toner particles in the other one of them is decreased only by passing them through a sieve. Then, density of each of the samples having pressed and sieved toner particles, respectively, is detected by the toner density sensor 1000. Subsequently, outputs from the toner density sensor 1000 are obtained as shown in FIG. 4. As shown, it is understood that even though actual toner density is the same, the output voltage of the toner density sensor 1000 is higher when aggregated toner (i.e., the apparent density increased soft toner) is detected than when not aggregated toner (i.e., the apparent density decreased soft toner) is detected. As a result, when the toner in the toner bottle 9 is relatively hard (i.e., aggregated) and is supplied, the above-described difference ΔT becomes negative, even though the toner density practically reaches the target. Consequently, the toner density in the developing device becomes more than the target.

Figure 5:
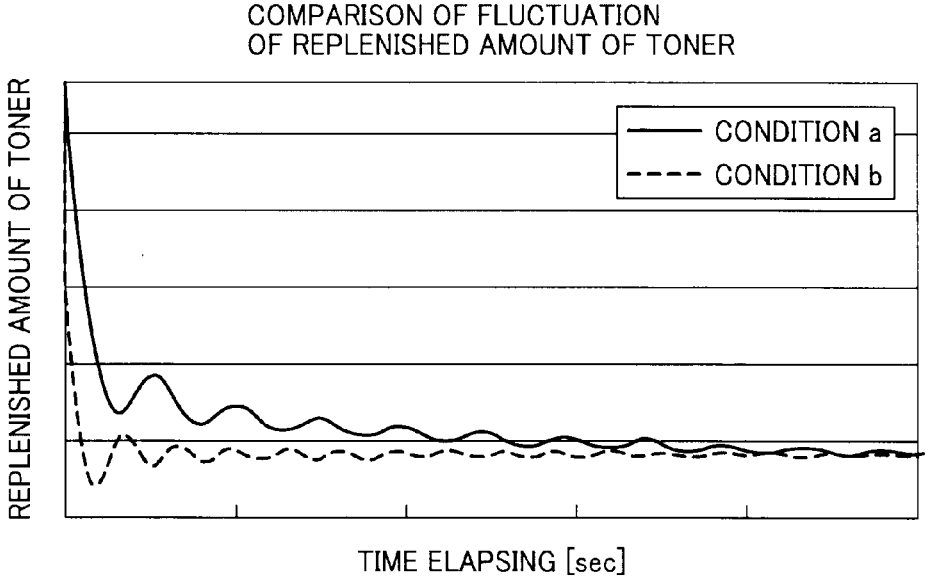
FIG. 5 illustrates an amount of each of relatively hard and soft toner particles supplied per unit time from a toner bottle.
Figure 6A:
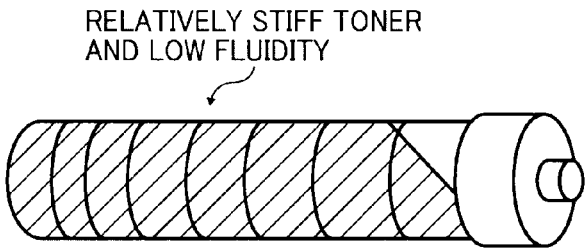
FIG. 6A illustrates a condition of the relatively hard toner stored in the toner bottle.
Figure 6B:
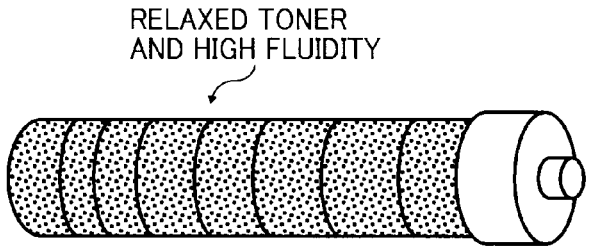
FIG. 6B illustrates a condition of the relatively soft toner stored in the toner bottle.

Further executed is another experiment in an amount of relatively hard toner replenished per unit time from the toner bottle 9 as shown in FIG. 6*a*, and that of relatively soft (e.g. dispersed) toner replenished per unit time therefrom as shown in FIG. 6*b*. The result of the experiment is shown in FIG. 5. As understood therefrom, a greater amount of the relatively hard toner is supplied per unit time from the toner bottle 9 than that of the relatively soft toner. As shown, a lot of toner is supplied right after start of toner replenishment, and the reason therefor is supposed that the toner remaining at the toner ejection outlet 192*a* and/or the nozzle 42 are supplied.

Further, as shown in FIG. 5, when a prescribed time has elapsed, a difference in amount between relatively hard (i.e., aggregated) toner and relatively soft (dispersion) toner each replenished from the toner bottle 9 per unit time disappears. That is, due to rotation of the bottle section 191, the toner stored therein is softened, thereby becoming soft. Hence, when the toner bottle 9 is rotated with some degree, the toner stored therein is softened, so that the soft toner can be supplied to the developing device. Accordingly, when the screw pump 31 operates only after a prescribed time of an softening operation of rotating the toner bottle 9, relatively soft toner can substantially always be supplied to the developing device 50 in a stable manner.

Now, a second embodiment is described. In the first embodiment, the softening operation is executed before the replenishment of toner. However, it is waste of time if the same softening operation is executed for not so aggregated toner as in increasingly aggregated toner. Specifically, the toner replenishment operation wastefully lasts longer, thereby increasing a downtime of an apparatus. Then, an agglomeration condition of toner stored in the toner bottle 9 is detected, and a time period (i.e., a number of rotations) for an softening operation is determined in accordance therewith as described hereinbelow.

As shown in FIG. 2, the toner bottle 9 includes a memory tag 194 serving as a non-volatile memory. The memory tag 194 includes a memory and a communication circuit for wirelessly communicating with a communication section, not shown, provided in an apparatus body. In the memory of the memory tag 194, there is stored information of a maximum toner replenishing capacity of the toner bottle 9, an apparent soft toner density as characteristic information of toner stored therein, and a toner replenishment coefficient described later in detail. Further stored in the memory is information of an amount of currently stored toner in the toner bottle 9 or the like. The apparent soft toner density is acquired in a below-described manner. Initially, 10 gram of toner is put into a measuring cylinder having 50 milliliter. Subsequently, the measuring cylinder is sealed with a cap, and is shaken by 50 times. The cylinder is subsequently uncapped and softly placed on a table. Subsequently, a scale is read about ten minutes later. A rate of the thus measured scale to an amount of toner measured is regarded as the apparent soft toner density. A manner of measuring the apparent soft toner density is not limited to the above describe system, and another system can be employed if it utilizes a similar principle.

The amount of currently stored toner in the toner bottle may be obtained based on a toner consumption amount calculated in accordance with a number of writing pixels or the like. Specifically, when image formation is completed, the controller 91 calculates a toner consumption amount in accordance with a number of writing pixels during the image formation at that time. The controller 91 then communicates with and reads out an amount of currently stored toner from the memory of the memory tag 194. Then, a new amount of currently stored toner is calculated by subtracting the toner consumption amount calculated as described above from the amount of currently stored toner read from the memory. The new amount of currently stored toner is overwritten in the memory tag 194 (i.e., the amount of currently stored toner is updated). In an initial stage of using the toner bottle, a maximum toner replenishment capacity is stored as an amount of currently stored toner.

Further, although the amount of currently stored toner is calculated based on the toner consumption amount calculated in accordance with the number of writing pixels or the like in the above described embodiment, it can be obtained based on an amount of toner practically replenished to the developing device 50. Such an amount of toner replenished to the developing device can be calculated based on a time period when the screw pump 31 operates.

The above-described toner replenishment coefficient represents an index that represents an agglomeration condition of toner in a toner bottle 9, and is calculated as described below. Specifically, it is calculated based on the maximum toner replenishment capacity, the apparent soft toner density, and the amount of currently stored toner each stored in the memory tag 194. For example, a toner replenishment coefficient C is calculated by the below described formula, when the maximum toner replenishment capacity is 1,540 [$cm^3$], the amount of currently stored toner is 550 [g], and the apparent soft toner density is 0.3 [$g/cm^3$];

$$C=550\div0.3\div1540\times100\approx120.$$

The toner replenishment coefficient is obtained when the toner replenishing operation is completed. Specifically, when the toner replenishing operation is completed, the controller 91 reads out the max toner replenishment capacity, the apparent soft toner density, and the amount of currently stored toner from the memory tag 194, and calculates the toner replenishment coefficient. The controller 91 subsequently communicates with the memory tag 194 and overwrites the thus calculated new toner replenishment coefficient in the memory of the memory tag 194. (i.e., the toner replenishment coefficient is updated).

Instead of calculating the amount of currently stored toner and the toner replenishment coefficient with the controller 91 of the apparatus body, a CPU can be provided in the memory tag 194 to calculate an a mount of currently stored toner and a toner replenishment coefficient. In such a situation, the memory tag 194 receives a toner consumed amount and a toner replenished amount from the apparatus body 99, and calculate an amount of currently stored toner and then a toner replenishment coefficient based thereon.

Figure 7:
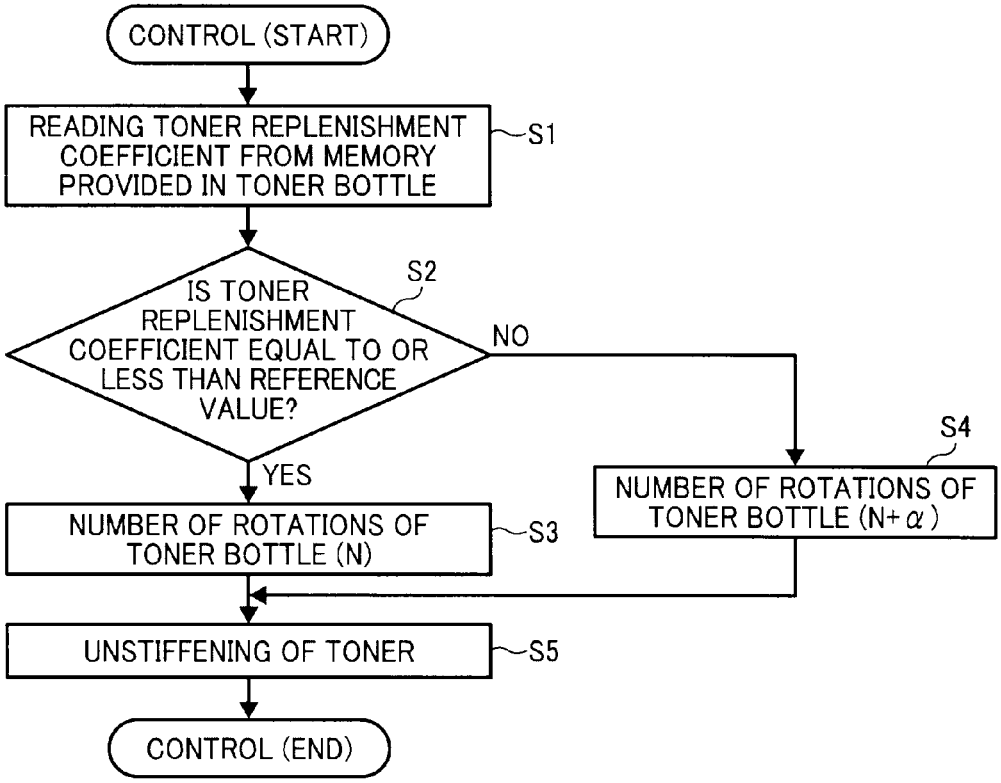
FIG. 7 illustrates a control sequence of softening the relatively hard toner executed before replenishment of the toner.

Now, an exemplary control sequence of a softening operation softening relatively hard toner before replenishing thereof is described with reference to FIG. 7. Initially, a toner replenishment coefficient stored in the memory tag 194 is read in step S1. Subsequently, it is determined if the thus read toner replenishment coefficient is equal to or less than a prescribed reference value previously obtained from an experiment in step S2. When the determination is positive (Yes, in step S2), since toner in the toner bottle 9 is sufficiently soft, an initial value N (for example 10), previously obtained from an experiment, is designated as a number of rotations of the toner bottle 9 in step S3. By contrast, when the determination is negative (No, in step S2), since the toner in the toner bottle 9 is hard (i.e., aggregated), the sum of N+a (for example three, totally 13), which is larger than the initial value N, is designated as a number of rotations of the toner bottle 9 in step S4, wherein the second item "a" represents a value previously obtained from an experiment. After the rotation number of the toner bottle 9 is determined in this way, an softening operation is executed to rotate the toner bottle 9 the thus determined number of times (i.e., thirteen times) in step S5. When such an softening operation is completed, a toner replenishment operation is executed based on a detection result of the toner density sensor 1000 in the above-described manner. After completion of the replenishment of toner, a toner replenishment coefficient is newly calculated in the above-described manner, and a calculation result is stored in the memory tag 194 (i.e., the previous toner replenishment coefficient is updated). Further, the controller 91 can recognize completion of the number of rotations of the toner bottle 9 based on a driving time period when the toner bottle 9 driving unit 120 is driven. That is, a prescribed time period for one rotation of the toner bottle is already known, and accordingly completion of one rotation can be recognized when the prescribed time has elapsed after the toner bottle driving unit 12 starts driving. Otherwise, such one rotation can be detected by an encoder or the like that detects a number of rotations of the toner bottle 9.

Hence, according to one embodiment of the present invention, when the toner in the toner bottle 9 is hard, a number of rotations of the toner bottle 9 is increased to 13 times for example, so that the toner is sufficiently softened before being replenished.

In other words, the toner is supplied only after being softened. Consequently, replenishment of the softened toner is stabilized. By contrast, when the toner is relatively soft in the toner bottle, since the number of rotations of the toner bottle 9 is decreased to 10 times for example, which is less than that for hard toner, an softening operation time period and accordingly a toner replenishment completion time period can be decreased. As a result, a downtime of the apparatus can be reduced. Further, since the memory tag 194 is provided in the toner bottle 9 previously storing information of a toner replenishment coefficient, a softening operation can be more quickly started than when the toner replenishment coefficient is calculated at that time. Further, since the memory tag 194 stores information of a maximum toner replenishing capacity and an apparent soft toner density or the like, a user does not need to input such information when the toner bottle is replaced with another, so that his or her labor is relieved increasing user friendliness. In addition, input mistakes resulting in incorrect calculation of a toner replenishment coefficient can be suppressed.

Now, various exemplary modifications are described with reference to several drawings.

Initially, a first exemplary modification is described with reference to FIG. 8. As shown, an exemplary relation between a toner replenishment coefficient and a number of rotations of a toner bottle in an softening operation which number causes constant replenishment of a prescribed amount of toner avoiding an error between actual toner density and density detected by the toner density sensor 1000 is illustrated. Such an exemplary relation is obtained in a below-described manner. First, various toner bottles having different toner replenishment coefficients are prepared. Then, a prescribed number of rotations that achieves constant replenishment of a prescribed amount of toner per unit time, and equalizes a detection result obtained by the toner density sensor 1000 with an actual toner density is investigated. Then, necessary numbers of rotations of the toner bottle are sought based on the investigation.

Figure 8:
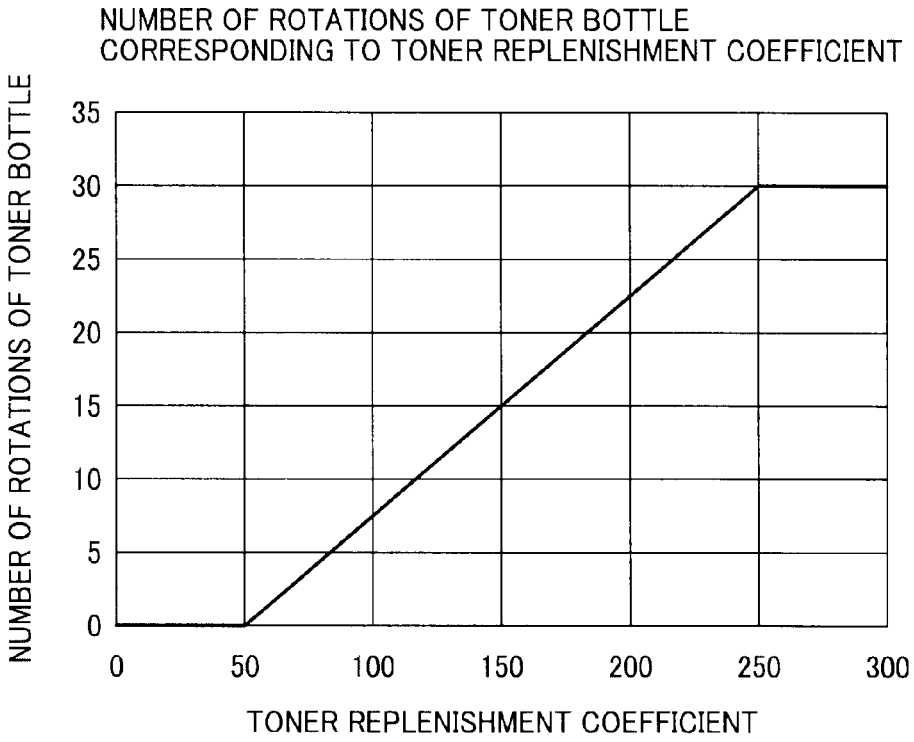
FIG. 8 illustrates a relation between a toner replenishment coefficient and a number of rotations of the toner bottle.
Figure 9:
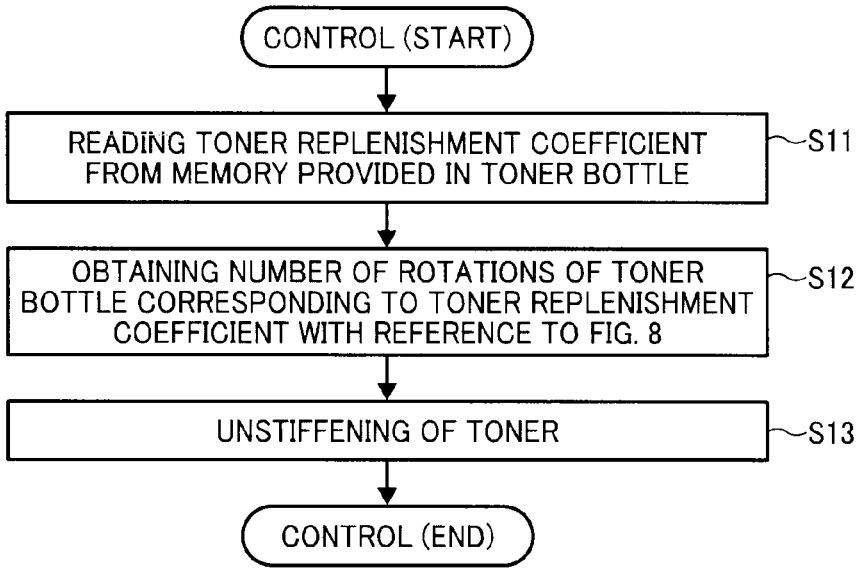
FIG. 9 illustrates a first exemplary modification of a control sequence of softening the relatively hard toner.

Then, a number of rotations of the toner bottle necessary to the sufficiently softening operation is precisely designated by a controller with reference to the relation between the toner replenishment coefficient and the necessary number of rotations of the toner bottle as illustrated in FIG. 8. For this purpose, a memory is provided in the controller 91 and stores information of a relational expression (for example, $Y=aX+b$) as shown in FIG. 8. A necessary number of rotations of the toner bottle is obtained by substituting a toner replenishment coefficient read from the memory tag 194 for an appropriate item in the relational expression. Instead of the above-described system, a prescribed table can be stored in the memory of the controller 91, which links a favorable number of rotations of the toner bottle with a toner replenishment coefficient. In any way, when the toner replenishment coefficient is 120, 10 times is designated to the number of rotations of the toner bottle, for example. Now, an exemplary sequence of the first exemplary modification is described with reference to FIG. 9. Initially, the controller 91 communicates with the memory tag 194 and reads a toner replenishment coefficient stored in the memory tag 194 in step S11. Subsequently, a favorable number of rotations of the toner bottle is determined for an softening operation based on the relation of FIG. 8. Subsequently, the softening operation is practiced and the toner bottle is rotated by the thus determined number of times in step S13.

Hence, since the first exemplary modification can precisely designate the prescribed number of rotations of the toner bottle effective to the softening operation, the toner is more effectively softened and the prescribed amount thereof is more constantly replenished while reducing the downtime of the apparatus.

Now, a second exemplary modification is described. Toner in a toner bottle tends to aggregate when temperature is relatively high, and contrary to disperse when it is relatively low. Then, according to the second exemplary modification, the toner replenishment coefficient is corrected in accordance with the temperature in the apparatus by a controller.

Figure 10:
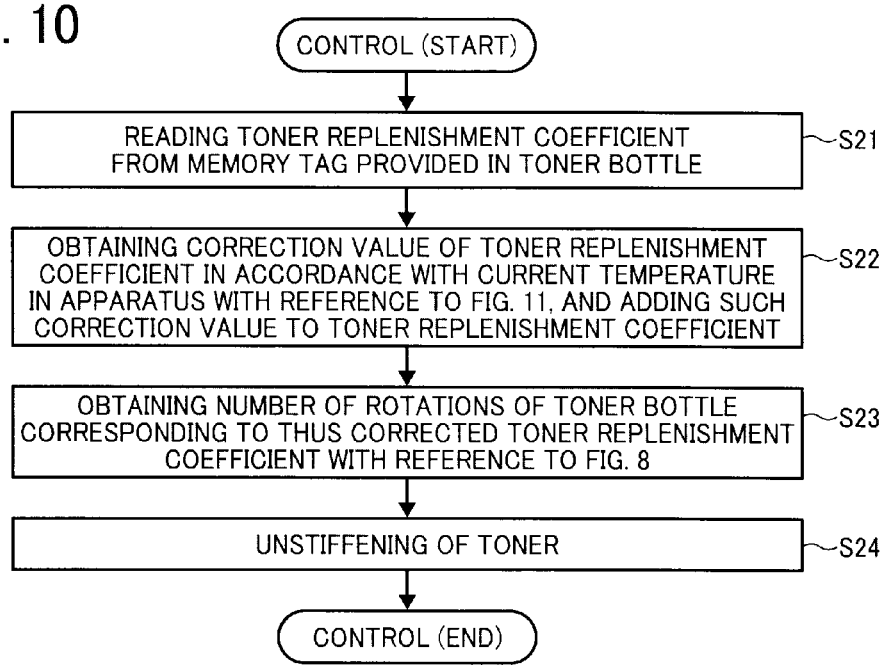
FIG. 10 illustrates a second exemplary modification of a control sequence of softening the relatively hard toner.
Figure 11:
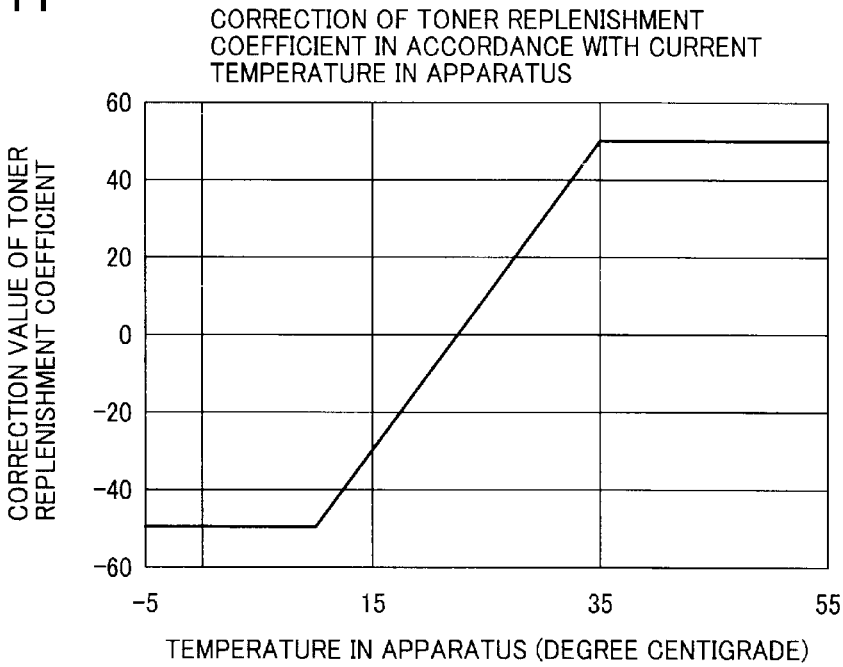
FIG. 11 illustrates a relation between a correction value correcting the toner replenishment coefficient and temperature.

Now, an exemplary control sequence of softening toner of the second exemplary modification is described with reference to FIG. 10. Similar to the various modifications as described above, the controller 91 initially communicates with the memory tag 194 and reads a toner replenishment coefficient stored therein in step S21. Subsequently, a temperature and humidity sensor 1001 reads temperature in the apparatus, and a correction value for correcting a toner replenishment coefficient is identified with reference to a relation between a toner replenishment coefficient correction value and temperature as shown in FIG. 11, which relation is previously obtained through an experiment. Such a relation can be a relational expression (e.g. $Y=aX+b$, wherein Y represents toner replenishment coefficient correction value and X represents temperature) stored in a memory included in the controller 91. Then, the thus identified correction value is added to the toner replenishment coefficient read from the memory tag 194 in step S22.

Further, the memory of the controller 91 can otherwise store a table showing the relation between a correction value of a toner replenishment coefficient and temperature of the apparatus. In any way, for example, when degree of temperature is 30 centigrade, a correction value of a toner replenishment coefficient is 20 as identified in the table. Therefore, when degree of temperature is 120 centigrade, a toner replenishment coefficient after correction becomes 140. Subsequently, based on a relation between the thus corrected toner replenishment coefficient (a toner replenishment coefficient of FIG. 8 and a necessary number of rotations of a toner bottle as shown in FIG. 8, a number of rotations of the toner bottle for softening toner reflecting the temperature is determined in step S23. For example, when a corrected toner replenishment coefficient is 140, a number of rotations of the toner bottle necessary for sufficiently softening toner is determined as 15 times. Subsequently, toner is softened by rotating the toner bottle by the thus determined number of times in step S24.

Hence, since toner is softened in accordance with environment in the second exemplary modification, the toner becomes more precisely softened in the toner bottle. As a result, replenishment of toner is more stabilized.

Now, a third exemplary modification is described. When toner in the toner bottle is left unmoved, agglomeration thereof proceeds. Then, according to the third exemplary modification, a time period having elapsed after the last softening operation is calculated, and a toner replenishment coefficient is corrected in accordance with the elapsing time by a controller.

Figure 12:
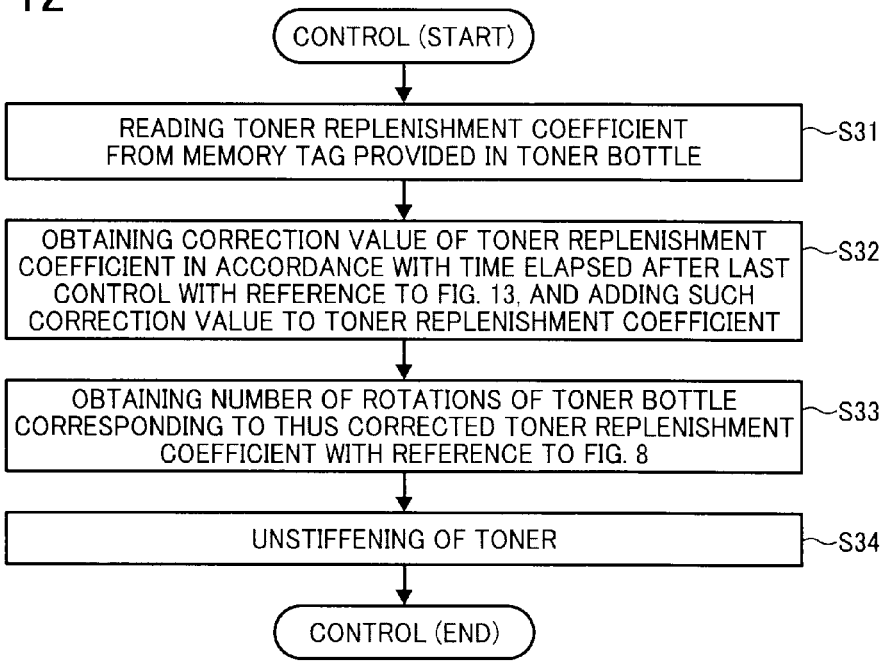
FIG. 12 illustrates a third exemplary modification of a control sequence of softening the relatively hard toner.
Figure 13:
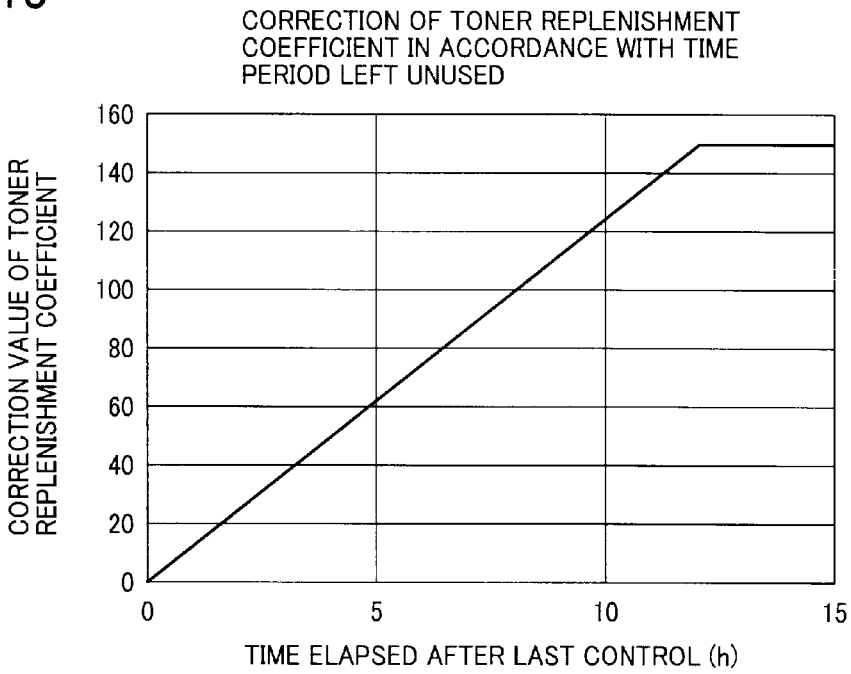
FIG. 13 illustrates a relation between a correction value correcting the toner replenishment coefficient and a time lapsed after the last softening of the relatively hard toner.

Now, an exemplary sequence of an softening operation executed in the third exemplary modification is described with reference to FIG. 12. Similar to the above-described various modifications, the controller 91 initially communicates with the memory tag 194 and reads a toner replenishment coefficient stored therein in step S31. Subsequently, a time period having elapsed after the last softening operation is calculated or timed by a timer 1002, and a correction value for correcting a toner replenishment coefficient is identified with reference to a relation between the elapsing time and a correction vale of the toner replenishment coefficient as shown in FIG. 13, which is previously obtained through an experiment. The relation between the elapsing time and a correction value for the toner replenishment coefficient may be a relational expression (e.g. Y=aX+b) stored in a memory included in the controller 91. For example, when the elapsing time is 5 hours, a correction value becomes 60. The thus identified correction value is then added to the toner replenishment coefficient read from the memory tag 194 in step S32. Specifically, when the toner replenishment coefficient read from the memory tag 194 is 120, a toner replenishment coefficient after the correction is 180, for example.

Subsequently, based on a relation between the thus corrected toner replenishment coefficient (, a toner replenishment coefficient of FIG. 8,) and a necessary number of rotations of a toner bottle, a number of rotations of the toner bottle for softening toner is determined in step S33. Specifically, when a corrected toner replenishment coefficient is 180, a number of rotations of the toner bottle needed for sufficiently softening toner is determined as 20 times. Then, toner is softened by rotating the toner bottle by the thus determined number of times in step S34.

Hence, according to the third exemplary modification, since toner can be softened for a time period in accordance with a time having elapsed after the last softening operation when the toner is left unmoved, the toner can more precisely be softened and precisely replenished from the toner bottle. Further, when the correction of the second exemplary modification is practiced together with that of the third exemplary modification, an softening condition of toner in the toner bottle can be more precisely recognized.

Instead of the rotation of a toner bottle, the toner bottle can be vibrated or is quickly locked in both normal and reverse directions alternatively to soften the toner therein. Instead of the screw pump 31 as a toner supplying device, the various devices can be employed. Further, instead of determining a number of rotations of a toner bottle based on the toner replenishment coefficient, a driving time period when the toner bottle driving unit 120 operates can be determined based thereon.

According to one embodiment of the present invention, toner can be appropriately replenished to the developing device 50 in a dispersed state avoiding excessive replenishment thereof. Further, density of toner is not detected to be lower than reality, and accordingly the density of the toner practically stored in the developing device can be suppressed from being higher than a target level thereof. Further, the above-described problem of deterioration of the yield and the abnormal image, such as toner scattering, etc., caused by excessive toner density can be suppressed. Further, a downtime can be reduced. That is, a toner replenishing device comprises a toner container to store toner, a toner replenishing device (a screw pump) to supply toner from the toner container to a developing device, and a toner condition detector to detect an aggregated condition of the toner stored in the toner container. Further, a toner softening device to soften toner stored in the toner container and a controller to drive the toner softening device for a prescribed time period in accordance with a detection result obtained by the toner condition detector are provided in the toner replenishing device.

According to another embodiment of the present invention, a condition of agglomeration of toner in the toner bottle can be recognized based on a fact that toner tends to aggregate when a less amount thereof is stored in a toner bottle and vice versa. That is, the toner condition detector recognizes the toner agglomeration condition based on a toner replenishment coefficient. The toner replenishment coefficient is obtained from a (maximum toner storing) capacity of the toner container, an amount of toner currently stored in the toner container (before replenishment thereof), and an apparent density of soft toner stored in the toner container. The apparent density of soft toner is obtained by dividing the total weight of the soft toner filling a bottle by a cubic value of the bottle.

According to yet another embodiment of the present invention, although a time period for driving the toner bottle driving unit 120 is decreased, the toner in the toner bottle can be effectively dispersed, and accordingly the downtime is reduced. In addition, toner in the toner bottle can be dispersed and is then supplied to the developing device. That is, the controller decreases the prescribed time period for driving the toner softening device to be shorter when the toner replenishment coefficient is equal to or less than a prescribed threshold than when the toner replenishment coefficient is more than the prescribed threshold.

According to yet another embodiment of the present invention, calculation of the toner replenishment coefficient can be omitted, and accordingly the softening operation of toner can be quickly started, thereby reducing the downtime of the apparatus. That is, the toner container is detachably attached to the image forming apparatus and includes a non-volatile memory to store a toner replenishment coefficient. The toner condition detector calculates and updates the toner replenishment coefficient in the non-volatile memory after every toner replenishment operation.

According to yet another embodiment of the present invention, an agglomeration condition of toner in the toner bottle can be recognized in consideration of a time period when the toner bottle is absent, so that toner is more appropriately softened. That is, the toner condition detector corrects the toner replenishment coefficient in accordance with a time period elapsed after the last toner replenishment operation, and detects the toner agglomeration condition based on the corrected toner replenishment coefficient.

According to yet another embodiment of the present invention, an agglomeration condition of toner in the toner bottle can be recognized in consideration of temperature in the image forming apparatus based on a fact that toner tends to aggregate when temperature therein is high and vice versa, so that toner is more appropriately softened. That is, the toner condition detector corrects the toner replenishment coefficient in accordance with temperature in the image forming apparatus, and detects the toner agglomeration condition based on the corrected toner replenishment coefficient.

According to yet another embodiment of the present invention, toner in the toner bottle can be efficiently softened. That is, the toner softening device rotates the toner container.

According to yet another embodiment of the present invention, a favorable image can almost always be obtained. That is, the image forming apparatus employs the toner replenishing device as described heretofore.

Numerous additional modifications and variations of the present invention are possible in light of the above teachings. It is therefore to be understood that within the scope of the appended claims, the present invention may be practiced otherwise than as specifically described herein.

What is claimed is:

1. A toner replenishing device comprising:

a toner container to store toner;

a toner replenishing device to supply toner from the toner container to a developing device;

a toner condition detector to detect an agglomeration condition of the toner stored in the toner container;

a toner softening device to soften toner stored in the toner container; and a controller to drive the toner softening device for a prescribed time period in accordance with a detection result obtained by the toner condition detector, wherein said toner condition detector detects the toner agglomeration condition based on a toner replenishment coefficient determined by the controller based on a maximum toner storage capacity of the toner container, an amount of toner currently stored in the toner container, and an apparent density of soft toner stored in the toner container, said apparent density of soft toner being obtained by dividing the total weight of the soft toner filling a bottle by a cubic value of the bottle.

2. The toner replenishing device as claimed in claim 1, wherein said toner condition detector detects the toner agglomeration condition based on a toner replenishment coefficient W calculated by the controller by the following formula:

$$W=X[g]\div Y[g/cm3]\div Z[cm3],$$

wherein X represents an amount of toner currently stored in a bottle, Y represents an apparent density of soft toner, said apparent density of soft toner obtained by dividing the total weight of the soft toner filling a bottle by a cubic value of the bottle, and Z represents a capacity of the bottle.

3. The toner replenishing device as claimed in claim 1, wherein said toner softening device is a drive unit that rotates the toner container, comprising:

a drive coupling that engages a driving force input section formed on a bottom of a bottle section; and a driving motor linked to the drive coupling through a shaft and a gear.

4. The toner replenishing device as claimed in claim 1, wherein said controller shortens the prescribed time period for driving the toner softening device when the toner replenishment coefficient is equal to or less than a prescribed threshold than when the toner replenishment coefficient is more than the prescribed threshold.

5. The toner replenishing device as claimed in claim 1, wherein the toner container is detachably attached to the image forming apparatus and includes a non-volatile memory to store the toner replenishment coefficient, and said toner condition detector updates and stores the updated toner replenishment coefficient in the non-volatile memory substantially after every toner replenishment operation.

6. The toner replenishing device as claimed in claim 1, wherein said toner condition detector corrects the toner replenishment coefficient in accordance with a time period elapsed after a precedent toner replenishment operation and detects the toner agglomeration condition based on the corrected toner replenishment coefficient.

7. The toner replenishing device as claimed in claim 1, wherein said toner condition detector corrects the toner replenishment coefficient in accordance with temperature in the image forming apparatus and detects the toner agglomeration condition based on the corrected toner replenishment coefficient.

8. An image forming apparatus comprising:

a latent image bearer to bear a latent image;

a developing device to develop the latent image to be a toner image on the latent image bearer by adhering toner to the latent image;

a toner replenishing system to replenish the toner from the toner container to the developing device, said toner replenishing system including:

a toner container to store toner;

a toner replenishing device to supply toner from the toner container to the developing device;

a toner condition detector to detect an aggregated condition of the toner stored in the toner container;

a toner softening device to soften toner stored in the toner container; and a controller to drive the toner softening device for a prescribed time period in accordance with a detection result obtained by the toner agglomeration condition detector; and a transfer device to transfer the toner image from the latent image bearer onto a recording medium, wherein said toner condition detector detects the toner agglomeration condition based on a toner replenishment coefficient determined by the controller based on a maximum toner storage capacity of the toner container, an amount of toner currently stored in the toner container, and an apparent density of soft toner stored in the toner container, said apparent density of soft toner being obtained by dividing the total weight of the soft toner filling a bottle by a cubic value of the bottle.

9. The image forming apparatus as claimed in claim 8, wherein said toner condition detector detects the toner agglomeration condition based on a toner replenishment coefficient W calculated by the controller by the following formula:

$$W=X[g]\div Y[g/cm3]\div Z[cm3],$$

wherein X represents an amount of toner currently stored in a bottle, Y represents an apparent density of soft toner, said apparent density of soft toner obtained by dividing the total weight of the soft toner filling a bottle by a cubic value of the bottle, and Z represents a capacity of the bottle.

10. The image forming apparatus as claimed in claim 8, wherein said toner softening device is a drive unit that rotates the toner container, comprising:

a drive coupling that engages a driving force input section formed on a bottom of a bottle section; and a driving motor linked to the drive coupling through a shaft and a gear.

11. The image forming apparatus as claimed in claim 8, wherein said controller shortens the prescribed time period for driving the toner softening device when the toner replenishment coefficient is equal to or less than a prescribed threshold than when the toner replenishment coefficient is more than the prescribed threshold.

12. The image forming apparatus as claimed in claim 8, wherein the toner container is detachably attached to the image forming apparatus and includes a non-volatile memory to store a toner replenishment coefficient, and wherein said toner condition detector updates and stores the toner replenishment coefficient in the non-volatile memory after every toner replenishment operation.

13. The image forming apparatus as claimed in claim 8, wherein said toner condition detector corrects the toner replenishment coefficient in accordance with a time period elapsed after the last toner replenishment operation and detects the toner agglomeration condition based on the corrected toner replenishment coefficient.

14. The image forming apparatus as claimed in claim 8, wherein said toner condition detector corrects the toner replenishment coefficient in accordance with temperature in the image forming apparatus and detects the toner agglomeration condition based on the corrected toner replenishment coefficient.

15. A toner replenishing device comprising:

a toner container having cylindrical shape for storing a toner;

a toner replenishing device for supplying the toner from the toner container to a developing device;

a toner condition detector for detecting an agglomeration condition of the toner stored in the toner container;

a toner softening device for softening the toner stored in the toner container by rotating the toner container; and a controller for driving the toner softening device for a prescribed time period in accordance with a detection result obtained by the toner condition detector.

16. The toner replenishing device as claimed in claim 15, wherein said toner softening device includes a drive unit that rotates the toner container.

17. The toner replenishing device as claimed in claim 16, wherein the drive unit comprises:

a drive coupling that engages a driving force input section formed on a bottom of a bottle section; and a driving motor linked to the drive coupling through a shaft and a gear.

18. The toner replenishing device as claimed in claim 15, wherein the controller controls the number of rotation of the toner container to adjust the prescribed timer period according to the detection result.

* * * * *